US006041574A

United States Patent [19]

Bennett

[11] Patent Number: 6,041,574

[45] Date of Patent: Mar. 28, 2000

[54] METHOD OF PRINTING FILM AT FORM-FILL-SEAL PACKAGING MACHINE AND FORM-FILL-SEAL PACKAGING MACHINE USING THE METHOD

[75] Inventor: Robert Bennett, Birmingham, United Kingdom

[73] Assignee: Ishida Co., Ltd., Kyoto, Japan

[21] Appl. No.: 08/995,918

[22] Filed: Dec. 22, 1997

[30] Foreign Application Priority Data

Dec. 23, 1996 [GB] United Kingdom ..... 9626696

[51] Int. Cl.[7] ..... B65B 61/26; B65B 9/06

[52] U.S. Cl. ..... 53/411; 53/51; 53/131.5; 53/451; 53/551; 493/188

[58] Field of Search ..... 53/411, 131.5, 53/131.4, 51, 450, 451, 550, 551, 552; 493/188

[56] References Cited

U.S. PATENT DOCUMENTS 5,188,580 2/1993 Rutledge et al. ..... 493/225

FOREIGN PATENT DOCUMENTS 0 564 288 A2 10/1993 European Pat. Off. .

*Primary Examiner*—James F. Coan
*Attorney, Agent, or Firm*—Staas & Halsey, LLP

[57] ABSTRACT

Accelerating the processing speed of a form-fill-seal packaging machine by continuously running a strip-like film, even if using a printing device of an intermittent printing type. Arm members (35) pivot around support axes (36) and are provided on a feed path of a strip-like film (F). Rollers (37,38) guiding the film (F) are provided at front and rear end portions of the arm members (35) whereby portions of the film (F) meander. A stopper member (32) stops the running of the film (F) and is disposed between accumulating portions (A, B). Printing is carried out on the film (F) by a printer (28) of an intermittent printing type in a period of time during which a portion of the film (F) is stopped by the stopper member (32). The continuous running of the film (F) is not hampered during this stoppage period since a portion of the film (F) is accumulated at the accumulating portion (A) on the downstream side.

11 Claims, 5 Drawing Sheets

METHOD OF PRINTING FILM AT FORM-FILL-SEAL PACKAGING MACHINE AND FORM-FILL-SEAL PACKAGING MACHINE USING THE METHOD

CROSS REFERENCE TO RELATED APPLICATIONS

This application is based upon and claims priority from British Patent Application No. 9626696.0 filed Dec. 23, 1996, the contents of which are incorporated herein by reference.

BACKGROUND OF THE INVENTION

1. Field of the Invention

The present invention relates to a method of printing a strip-like film in a form-fill-seal packaging machine and enclosing commodities into packaging bags while forming the strip-like film onto the packaging bags and a form-fill-seal packaging machine using the printing method.

2. Description of the Related Art

As disclosed in, for example, Japanese Unexamined Patent Publication No. 1362/1991, there is known a FORM-FILL-SEAL packaging machine in which a strip-like film is unreeled from a roll. While running the film along a running path, the film is curved into a cylindrical shape at a downstream end portion of the running path. Overlapped end edge portions and lower end portions of the cylindrical film are respectively bonded and sealed. Thereafter, commodities are supplied. Afterwards, upper end portions of the cylindrical film are similarly welded, sealed and separated by cutting whereby packaging bags enclosed with the commodities are successively formed.

In this case, as disclosed in, for example, Japanese Unexamined Utility Model No. 32611/1984 or Japanese Unexamined Patent Publication No. 127533/1994, a printing device such as a printer is arranged on the running path of the film and predetermined information such as the manufacturing date, manufacturing number, etc. is printed on the film before the film is introduced into the downstream end portion and is formed into bags. In such a case, there are form-fill-seal packaging machines of a type continuously running the film and a type intermittently running the film. Further, there are printing systems, which are known, with respect to the film in accordance with the types of the form-fill-seal packaging machines and a continuous printing type printing on the film while rotating a printing unit of a printing device in synchronism with the running of the film and an intermittent printing system printing the film in a period of time during which the film is intermittently stopped.

According to the continuous printing system, the strip-like film can be run continuously and therefore, the processing capacity of the form-fill-seal packaging machine is increased. However, a complicated synchronizing mechanism must be adopted at the printing unit and it is also necessary to reset timings of the rotational movement of the printing unit and the printing operation in accordance with the change of the length of the bag or the location of printing.

According to the intermittent printing system, the constitution as well as the control of the printing timing are comparatively simplified and therefore, the printing device per se is inexpensive. However, the form-fill-seal packaging machine is inferior in view of its processing capacity since the strip-like film must be stopped at every printing.

SUMMARY OF THE INVENTION

Hence, the problem which the present invention overcomes is a problem of providing a method of printing film in a form-fill-seal packaging machine and a form-fill-seal packaging machine using the printing method, having the following advantages. The present invention is capable of both continuous printing and intermittent printing, and is capable of continuously running a film even if the intermittent printing system is adopted and preventing the processing capacity of the form-fill-seal packaging machine from being decreased.

In order to resolve the above-mentioned problem, the present invention is directed to, according to a first embodiment of the present invention, a method of printing a strip-like film in a form-fill-seal packaging machine supplying commodities to packaging bags and sealing the packaging bags while forming the strip-like film into the packaging bags. The method includes continuously feeding the strip-like film while accumulating and discharging portions of the strip-like film at film accumulating portions provided at two locations along the feed path of the strip-like film, and, intermittently stopping and printing portions of the strip-like film at a location between the accumulating portions while continuing to feed other portions of the strip-like film.

According to a second embodiment of the present invention, there is provided a form-fill-seal packaging machine supplying commodities to packaging bags and sealing the packaging bags while forming a strip-like film into the packaging bags. The form-fill-seal packaging machine includes a driving unit to continuously feed the strip-like film, an upstream side and a downstream side accumulating unit to respectively accumulate portions of the strip-like film at two locations along the feed path of the strip-like film, a unit to intermittently stop a portion of the strip-like film at a location between the upstream side and the downstream side of the accumulating unit, wherein the upstream side and downstream side accumulating units store sufficient film to allow other portions of the film to continue to be fed while a portion of the strip-like film is stopped intermittently by the intermittently stopping unit, and a printer to print on the portion of the strip-like film which is stopped between the downstream side and the upstream side accumulating units in the period of time during which the portion of the strip-like film is stopped.

According to the first embodiment and the second embodiment of the present invention, the strip-like film can continuously run with portions thereof being accumulated and discharged from the two accumulating locations along the feed or running path and the intermediate portion thereof intermittently stops at the location between these accumulating portions.

Typically, the film follows a meandering path within the accumulating portions, the length of each path being variable to allow further film to be accumulated or discharged.

Thus, during the period of time where the portions of the strip are intermittently stopped, the portion of the film accumulated at the downstream side accumulating portion is discharged to the downstream side of the feed path and the portion of the film flowing from the upstream side of the feed path is accumulated at the upstream side accumulating portion by decreasing the length of the meandering path on the downstream side and increasing the length of the meandering path on the upstream side. Meanwhile, conversely, during the period of time where the strip is run intermittently, the portion of the film accumulated at the upstream side accumulating portion flows out to the downstream side and the flowed-out portion of the film is accumulated at the downstream side accumulating portion by decreasing the length of the meandering path on the upstream side and increasing the length of the meandering path on the downstream side. In this way, the portions of the film can be intermittently stopped at the location between the accumulating portions without hampering the continuous running of other portions of the film and at this period of time the film can be printed. As a result, the continuous running of the film can be conducted even if an inexpensive intermittent printing system is adopted whereby the processing capacity of the bag forming packaging machine is not decreased.

Preferably, each of the upstream side and the downstream side accumulating units includes at least one roller member which causes the feed path of the strip-like film to meander in a S-like shape. The machine further includes a meandering amount adjusting unit including a support member having the downstream and the upstream side accumulating units at each end portion thereof, the support member being pivoted so as to perform a seesaw motion with an intermediate position between the upstream side and the downstream side accumulating means as a fulcrum such that when the meandering amount of one of the upstream side accumulating unit and the downstream side accumulating unit is increased, the meandering amount of the other thereof is decreased.

In this case, the meandering amount at the upstream side accumulating portion and the meandering amount at the downstream side accumulating portion can reciprocally be increased and decreased when the two accumulating units provided at each end portion of the support member conduct a seesaw motion.

The machine may further include a detector to detect detectable portions on the strip-like film positioned at intervals each corresponding to a length of the packaging bag, the detector being provided adjacent the feed path of the strip-like film, and the stopping unit being responsive to the detector so as to stop a portion of the strip-like film based on the detection of a detectable portion by the detector.

Thus, the printing of the film is always performed at predetermined locations even if the size of the packaging bag or the running speed of the film is changed.

BRIEF DESCRIPTION OF THE DRAWINGS

The method and apparatus described above are subject to variations, which will be evident to one skilled in the art to which the present invention pertains, as well as economies of manufacture and methods of use, from a study of the following detailed description and the appended drawings, all of which form a part of this application. In the drawings.

DETAILED DESCRIPTION OF THE PRESENTLY PREFERRED EMBODIMENTS

An explanation will be given of the embodiments of the present invention with reference to the drawings.

Figure 1:
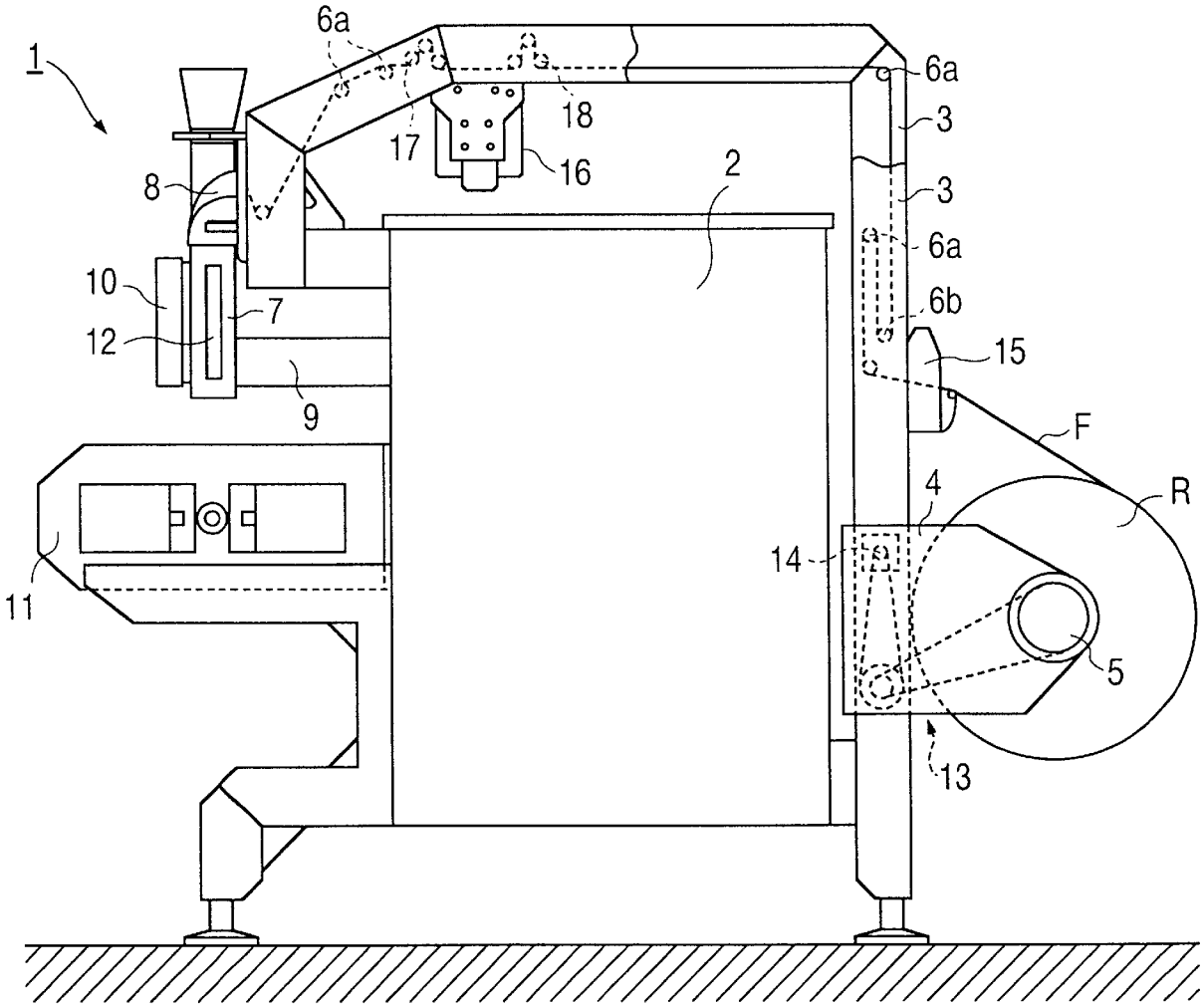
FIG. 1 is an outline side view showing the total constitution of the form-fill-seal packaging machine mounted with a film printing device.

FIG. 1 is an outline side view of a form-fill-seal packaging machine 1 on which a film printing device 16 in accordance with an example of the present invention is mounted. An explanation will first be given of the total constitution of the form-fill-seal packaging machine 1 and the flow of a film F with reference to FIG. 1. This form-fill-seal packaging machine 1 is of a type continuously running the film and is provided with a pair of left and right frames 3 extending from the rear side to the upper side and finally to the front side of a main body 2. A roll R of the strip-like film F is rotatably supported at the rear portion of the frames 3 via brackets 4 and a drive shaft 5. The film F unreeled from the roll R is transferred to the front side of the main body 2 along the frames 3 while being guided by a plurality of fixed rollers 6*a*, a dancer roller 6*b* etc. which are provided to span between the frames 3.

A cylindrical chute 7 arranged to extend in the vertical direction for inputting commodities and a forming unit 8 of a predetermined shape arranged to surround the chute 7, are provided at the front portions of the frames 3. The strip-like film F transferred along the frames 3 is wrapped around a peripheral face of the chute 7 via the forming unit 8. At the same time both side edge portions of the film F are overlapped on the peripheral face of the chute 7 and under this state the film F is further transferred in the downward direction along the chute 7.

Further, a vertical sealing device 10 is arranged to oppose the chute 7 via an L-shaped support arm 9 extended from the main body 2 forwardly to surround the chute 7. The two side edge portions of the film F overlapped on the peripheral face of the chute 7 are press-contacted to the side of the chute 7 by the vertical sealing device 10, and heated and bonded under this state.

A horizontal sealing device 11 is arranged below the cylindrical chute 7 for sealing, in the transverse direction, the cylindrical film which has been transferred from the chute 7 in the downward direction and is hanging down. The device 11 incorporates a cutter device which separates by cutting a preceding portion of the film from a succeeding portion thereof at a center position of the sealing portion. Although not illustrated in detail, the transverse sealing device 11 is constituted such that a pair of seal jaws press-contacting the cylindrical film in the transverse direction move downwardly under a state where the cylindrical film is pinched, whereby the cylindrical film or the strip-like film F can continuously be transferred without stopping it at each time of the transverse sealing. In succession to the transverse sealing of the cylindrical film by the transverse sealing device 11, commodities are input from the chute 7. Thereafter, the transverse sealing and cutting of the film is carried out while the cylindrical film is being transferred in the downward direction and finally the packaging bags are discharged.

Transfer belts 12 transferring the cylindrical film continuously in the downward direction (while adsorbing it for example under vacuum or via friction) are provided at both sides of the cylindrical chute 7 although only one of them is illustrated. The strip-like film F unreeled from film roll R is run continuously on the running path through the continuous driving of the pair of transfer belts 12 provided in front of the main body 2.

Further, a motor 14 which transmits a rotational driving force to the drive shaft 5 via a transmission mechanism 13 to feed the film F from the roller R is stored at the rear portion of one of the frames 3. Thereby, the film roll R is rotated, the load of the transfer belts 12 is alleviated and application of excessive pulling force on the strip-like film F running on the running path is avoided.

Incidentally, although a splicer 15 is arranged above the film roll R, a detailed explanation thereof will be omitted.

Next, an explanation will be given of the film printing device 16. The printing device 16 is installed midway along the feed path of the film F at the upper portion of the frames 3 and prints predetermined information such as manufacturing date, manufacturing number etc. on the film F before the strip-like film F unreeled from the film roll R reaches the downstream end portion of the feed path and is formed into the packaging bags by the forming unit 8, the chute 7 etc. In that case, as mentioned, above this form-fill-seal packaging machine 1 is of a type continuously running the film F and the printing device 16 is constituted to be able to print on the film by using a printer of an intermittent printing type without hampering the continuous running of the film. An explanation will firstly be given of the mechanical structure of the printing device 16 as follows.

The printing device 16 is provided with a structure substantially symmetrical with respect to left and right sides of the machine 1. An enlarged longitudinal sectional view thereof in the proximity of one of the frames 3 in view from the side of the packaging machine 1 and an enlarged longitudinal sectional view in view from the rear side of the packaging machine 1 are shown respectively by FIG. 2 and FIG. 3.

First, the printing device 16 is provided with two front and rear rollers 17 and 18 rotatably provided to span between comparatively forward portions in the upper portions of the frames 3 mutually at the same height. Two vertical wall members 20 are attached to the opposing inner faces of the frames 3 by bolts 19, 19 to expand downwardly from the frames 3 between the fixed rollers 17 and 18. A pair of left and right support brackets 21 which are bent in a predetermined shape, are fixed to the comparatively upper portions of the vertical wall members 20 by bolts 22 to oppose each other.

Each of the support brackets 21 is provided with an attaching face 21*a* to which the bolts 22 are fastened, an intermediate face 21*b* extending in the inner direction between the frames 3 and a support face 21*c* erected upwardly from the intermediate face 21*b*. A front fixed roller 23 and a rear fixed roller 24 for horizontally guiding the strip-like film F are rotatably provided to span between the upper portions at the front and rear portions of the support faces 21*c*.

Further, the upper edge portions of the respective support faces 21*c* between the fixed rollers 23 and 24, are bent to the inner direction between the frames 3 thereby forming respectively flanges 25. Also, a contact plate 26 having a channel-like sectional shape is provided to span between the flanges 25. A flat buffer member 27 formed by using rubber, soft silicone resin etc. is pasted on the bottom face of the contact plate 26 and the strip-like film F guided by the front and rear fixed rollers 23 and 24, runs along the bottom face of the buffer member 27. A printer 28 of an intermittent printing type is arranged below the buffer member 27 and printing is conducted on the film F horizontally running along the bottom face of the buffer member 27 at predetermined timings.

Meanwhile, pins 29 protrude from the rear portions of the lower expanded portions of the vertical wall members 20 while tail portions of extracting and retracting piston rods 30*a* of air cylinders 30 are attached to the pins 29 relatively rotatably with respect to the pins 29. Pivoting members 31 connected to the piston rods 30*a* of the air cylinders 30 by pins 30*b* relatively rotatably with respect to the pins 30*b*, are axially supported rotatably below the flanges 25 or the buffer member 27 at the front portions of the support faces 21*c* of the support brackets 21. A stopper member 32 is provided to span between boss portions 31*a* installed at pivoting shafts of the pivoting members 31. The pivoting members 31 are pivoted by extraction and retraction of the piston rods 30*a* through activation and deactivation of the air cylinders 30. When the air cylinders 30 are deactivated and the piston rods 30*a* are retracted, the stopper member 32 is brought into contact with the buffer members 27 and stops a portion of the running strip-like film F by squeezing it between the stopper member 32 and the buffer member 27 (refer to FIG. 2 or FIG. 4). Conversely, when the air cylinders 30 are activated and the piston rods 30*a* are extracted, the stopper member 32 is separated from the buffer member 27 whereby the portion of the strip-like film F is released (refer to FIG. 5).

Extracting and retracting piston rods 33*a* of second air cylinders 33 are provided in the vertical direction at the lower expanded portions of the vertical wall members 20 respectively via brackets 34. The piston rods 33*a* of the air cylinders 33 extend through holes formed at the intermediate faces 21*b* of the support brackets 21, into spaces between the support faces 21*c* of the support brackets 21 and the vertical wall members 20. Arm members 35 extending in the forward and rearward direction are rotatably attached to the front end portions of respective piston rods 33*a* by pins 36.

Figure 2:
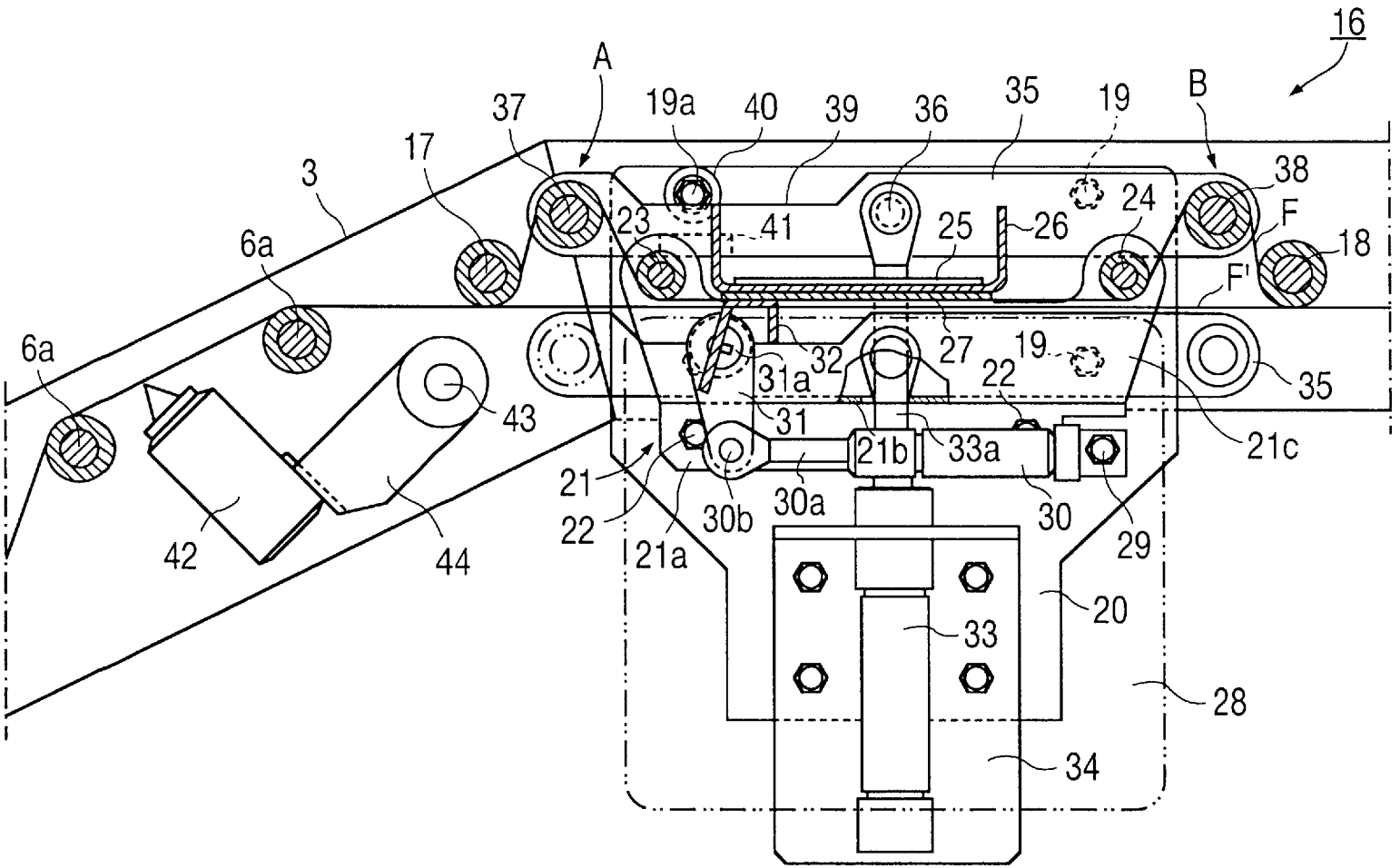
FIG. 2 is an enlarged side view of the film printing device.
Figure 3:
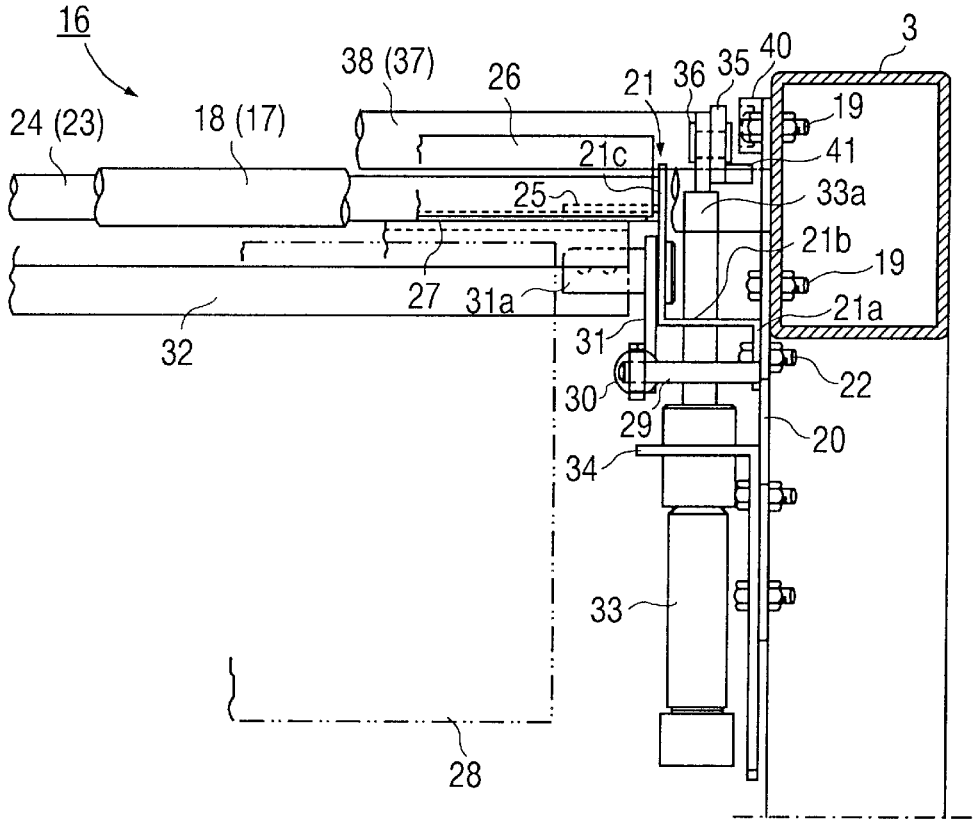
FIG. 3 is an enlarged back view of the film printing device.

Furthermore, rollers 37 and 38 respectively guiding the strip-like film F are rotatably provided to span between pivoting end portions at the front and rear portions of the arm members 35. In that case, the front and rear pivoting rollers 37 and 38 pivot at locations respectively between the front and rear fixed rollers 17 and 18 provided to span between the frames 3 interposing the vertical wall members 20, and the front and rear fixed rollers 23 and 24 attached to the support faces 21*c* of the support brackets 21. As illustrated in FIG. 2 or FIG. 3, when the second air cylinders 33 are activated and the piston rods 33*a* are extracted, the arm members 35 are elevated and the pivoting rollers 37 and 38 at the front and rear positions of the arm members 35, are disposed above the respective fixed rollers 17, 18, 23 and 24. Conversely, as shown by chain lines in FIG. 2, when the second air cylinders 33 are deactivated and the piston rods 33*a* are retracted, the arm members 35 are lowered down to the intermediate faces 21*b* of the support brackets 21 and are disposed below the respective fixed rollers 17, 18, 23 and 24.

In the normal running of the film F, as illustrated in FIG. 2, the cylinders 33 for elevating and lowering the arms are activated and portions of the strip-like film F running between the buffer member 27 and the printer 28, meander at the front and rear sides thereof within respective accumulating locations A, B defined by rollers 17, 23, 34 and 18, 24, 38. The cylinders 33 for elevating and lowering the arms are deactivated when, for example, the film is first set on the feed path, or the like. Thereby, as illustrated in FIG. 2 by the chain lines, the film F can be set horizontally whereby the selling operation can be facilitated. However, the cylinders 33 could be omitted and the arms fixed in their elevated position, in a simpler construction.

Figure 4:
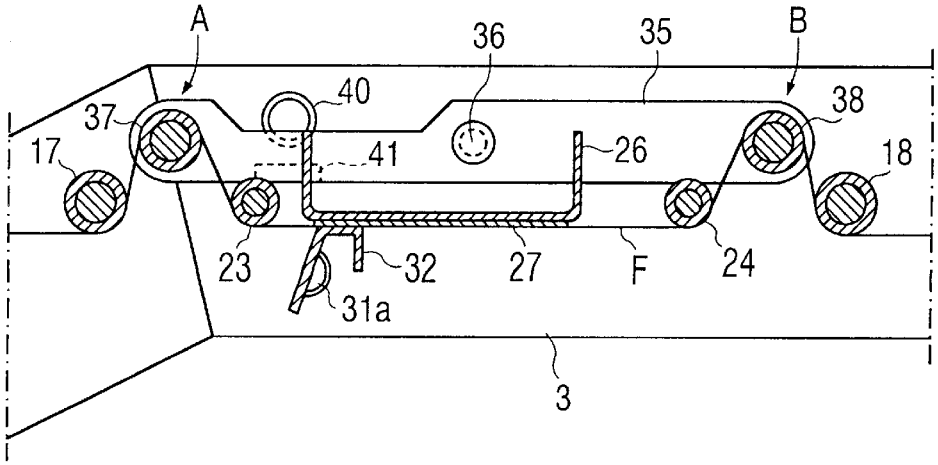
FIG. 4 is an explanatory view showing one operational state of the film printing device.
Figure 5:
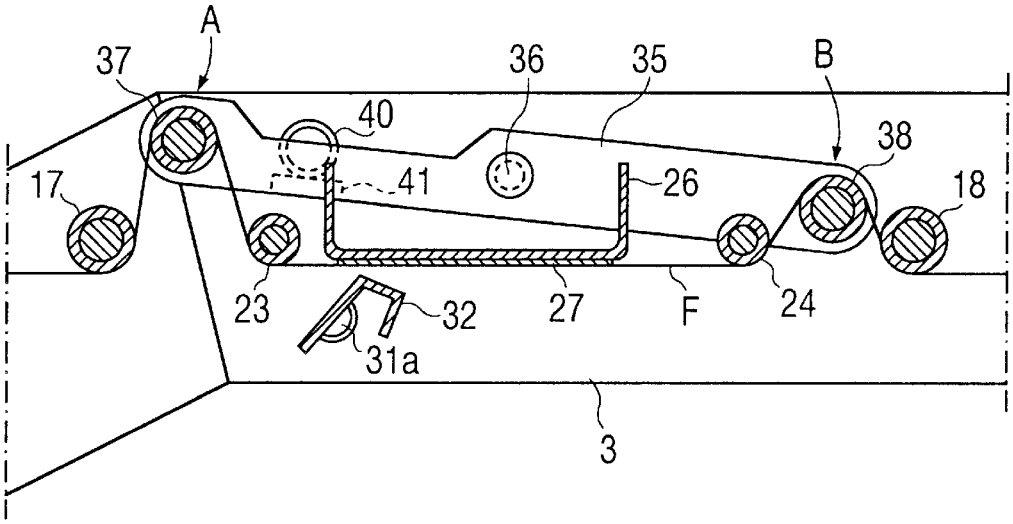
FIG. 5 is an explanatory view showing another operational state of the film printing device.

The intervals between the pivoting centers (pins 36) of the respective arm members 35 and the front and rear pivoting rollers 37 and 38 are equally set whereby the amounts of increase and decrease of meandering of the film F at the front and rear accumulating portions A and B are equalized when the arm members 35 are horizontally disposed as illustrated in FIG. 2 or FIG. 4 as well as when the arm members 35 are inclined in either direction as illustrated in FIG. 5 (in the illustrated example the arm members 35 are inclined such that the front pivoting rollers 37 are elevated and the rear pivoting rollers 38 are lowered).

Notched portions 39 are provided at the front portions of the respective arm members 35 whereby the centers of gravity of the arm members 35 are located at the rear portions thereof. If there is no action from outside, the arm members 35 are inclined such that the front pivoting rollers 37 are elevated and the rear pivoting rollers 38 are lowered as illustrated in FIG. 5. Protruded portions 41 are formed at the front portions of the arm members 35 for bringing the protruded portions 41 in contact with contact members 40 installed on respective ones of the attaching bolts 19*a* of the vertical wall members 20 whereby the inclination of the arm portions 35 is restricted.

Figure 6:
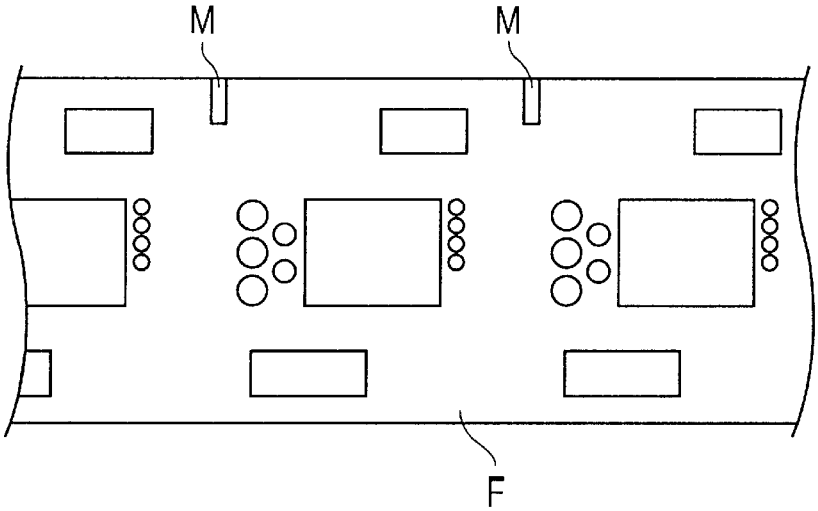
FIG. 6 is an explanatory view of counter marks provided on the strip-like film.

A counter mark sensor 42 is arranged between the two fixed rollers 6*a* arranged in front of the downstream side accumulating portion A on the feed path of the film via a bracket 44 provided pivotably around the center of a shaft 43. The position thereof is adjustable with respect to the film F running between the fixed rollers 6*a*. The counter mark sensor 42 detects counter marks M (FIG. 6) previously provided on the strip-like film F at intervals each of a length of a bag and outputs a detection signal when it detects the mark M.

Figure 7:
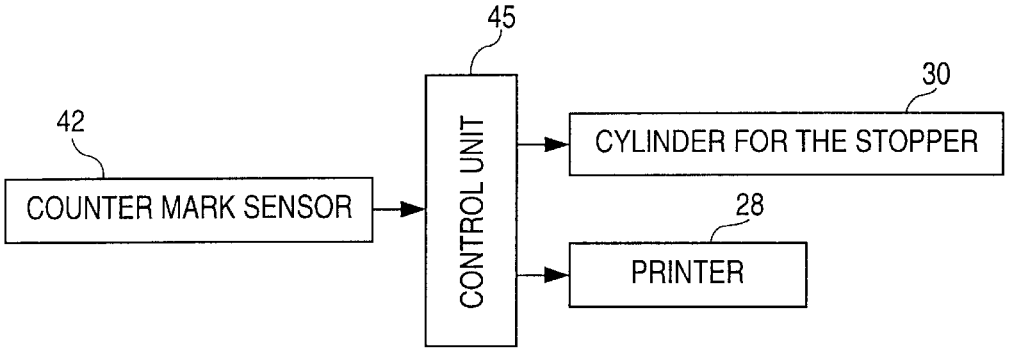
FIG. 7 is a control system diagram of the film printing device.

A printing control unit 45 outputting ON and OFF signals to the first air cylinders 30 driving the stepper member 32 and the printer 28 based on the counter mark detection signal from the counter mark sensor 42, is connected to the printing device 16 as illustrated in FIG. 7.

Figure 8:
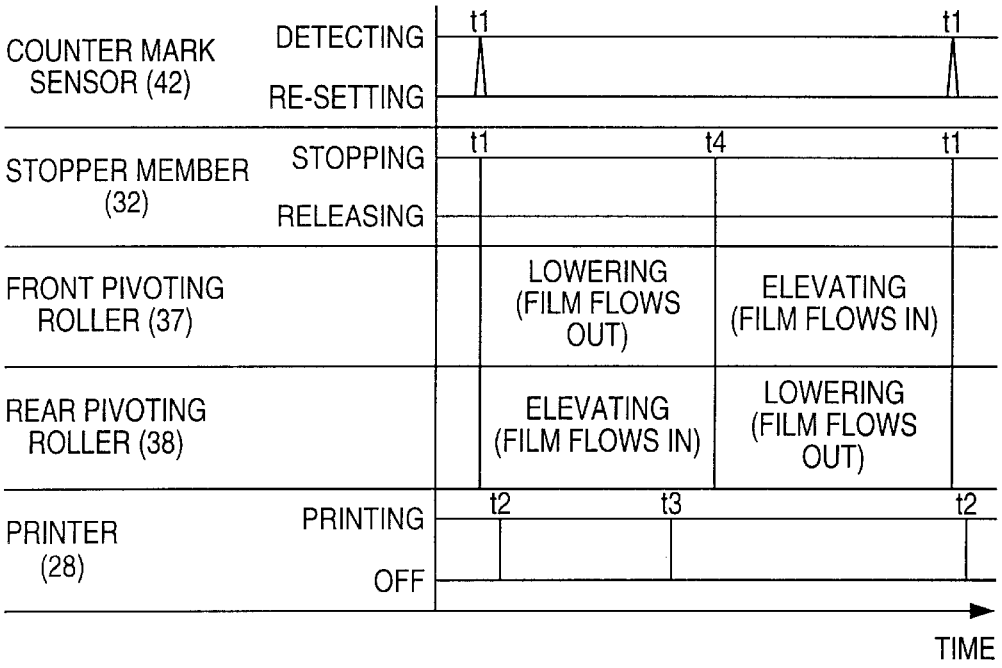
FIG. 8 is a time chart diagram of a film printing operation by the film printing device.

Next, an explanation will be given of a printing method of film in accordance with an example of the present invention that is carried out by using the printing device 16, with reference to the control system diagram of FIG. 7 and the time chart diagram of FIG. 8.

When the cylinders 30 for the stopper member 32 are activated, the stopper member 32 releases the strip-like film F so that the whole film F is continuously running on the feed path. At this stage, the strip-like film F is running by being pulled from the forward portion of the feed path by the transfer belts 12. At the same time, the film is fed from the rearward portion by the sending motor 14 arranged at the rearward portion of the feed path, substantially at the same speed. Therefore, as mentioned above, no excessive pulling force is applied on the strip-like film F on the feed path. Accordingly, as illustrated in FIG. 5, the arm members 35 are inclined such that the front pivoting rollers 37 are elevated and the rear pivoting rollers 38 are lowered by the gravity centers at the rear portions thereof. In other words, the whole system is in a state where the length of the film within the downstream side accumulating portion A is relatively large and the length of the film in the upstream side accumulating portion B is relatively small.

Now, with the progress of the strip-like film F the counter mark M on the film F is detected by the counter mark sensor 42 and the detection signal is input to the control unit 45, whereby the control unit 45 deactivates the cylinders 30 for the stopper and stops a portion of the film F between the front and rear accumulating portions A and B (time point t1). Then, since the film F is pulled from the forward portion by the transfer belts 12, the pulling force operates on the front end portions of the arm members 35 whereby the front pivoting rollers 37 are lowered against the weight of the rear portions as illustrated in FIG. 4 whereby the length of the film meandering within at the downstream side accumulating portion A is decreased. At the same time, the rear pivoting rollers 38 are elevated and the length of the film meandering within the upstream accumulating portion B is increased. The control unit 45 executes printing by the printer 28 with respect to the portion of the film of which running is stopped by the stopper member 32 before the front pivoting rollers 37 are lowered and a stored amount of the film F at the downstream side accumulating portion A is exhausted (t2–t3). The control unit 45 then actuates the cylinders 30 to release the stopper members 32 and runs the whole film F again continuously (t4). Then, the system returns to the above-described state of FIG. 5 and the rear pivoting rollers 38 of the arm members 35 are lowered under gravity whereby the portion of the film F flows out from the upstream side accumulating portion B to the downstream side accumulating portion A. At the same time, the front pivoting rollers 37 are elevated, and the flowed-in film F is accumulated at the downstream side accumulating portion A and the length of the film meandering amount is restored.

According to this printing method, the strip-like film F continuously runs while respectively meandering at the predetermined two locations A and B along the feed path and portions thereof are intermittently stopped between these accumulating portions A and B. In that case, the portions of the film F meander at the accumulating portion A on the downstream side and the accumulating portion B on the upstream side and accordingly, the meandering portions of the film F are stored.

In the period of time during which the portions of the film F are intermittently stopped by the stopper members 32, the length of film within the accumulating portion A on the downstream side is small and the length of film within the accumulating portion B on the upstream side is large. The portion of the film F accumulated at the downstream side accumulating portion A flows out to the downstream side of the running path and the portion of the film F flowing in from the upstream side of the running path to the upstream side accumulating portion B is accumulated. Conversely, in the period of time during which the whole film F continuously runs when the stopper members 32 are released, the length of film within the accumulating portion B on the upstream side is small and the length of film within the accumulating portion A on the downstream side is large whereby the portion of the film F accumulated at the upstream side accumulating portion B flows out to the downstream side and the portion of the film F flowing in from the upstream side to the downstream side accumulating portion A is accumulated. Thereby, portions of the film F can be stopped intermittently between the accumulating portions A and B while maintaining the processing capacity of the form-fill-seal packaging machine 1 without hampering the continuous running of the film F. The printing can be carried out on the film F in the period of time during which the portions of the portions of the film are intermittently stopped by using the printer 28 of an intermittently printing type of which structure and control are comparatively facilitated and which is inexpensive.

The respective meandering lengths at the downstream side accumulating portion A and the upstream side accumulating portion B are reciprocally increased and decreased by pivoting the arm members 35, the pivoting centers 36 of the arm members 35 being disposed at the middle points of the pivoting rollers 37 and 38. Therefore, an increase in the meandering amount at one of the accumulating portions is equal to a decrease in the meandering amount at the other one thereof whereby smooth continuous running of the film F is realized.

Furthermore, the printing is carried out at a time corresponding to the detection of one of the counter marks M. Since these marks M are provided at intervals each corresponding to a length of a packaging bag, even if the size of the packaging bag or the feed speed of the film F is changed, the printing on the film F is always carried out at predetermined locations.

As has been described above, according to the present invention the film can be run continuously while adopting the intermittent printing system of which constitution and control are comparatively facilitated and therefore, the reduction in manufacturing cost and the promotion in the processing capacity of a bag forming packaging machine can be compatible with each other.

While the present invention has been described in connection with what are currently considered to be the most practical and preferred embodiments, it is to be understood that various arrangements and alternative embodiments are intended to be included within the scope of the appended claims.

What is claimed is:

1. A method of printing on a strip-like film in a form-fill seal packaging machine supplying commodities to packaging bags and sealing the packaging bags while forming the strip-like film into the packaging bags, said method comprising:

continuously feeding the strip-like film while accumulating and discharging portions of the strip-like film at film accumulating portions provided at two locations along the feed path of the strip-like film; and intermittently stopping and printing on portions of the strip-like film at a location between the accumulating portions while continuing to feed other portions of the strip-like film.

2. A form-fill-seal packaging machine supplying commodities to packaging bags and sealing the packaging bags while forming a strip-like film into the packaging bags, said form-fill-seal packaging machine comprising:

means for continuously feeding the strip-like film;

an upstream side and a downstream side means for respectively accumulating portions of the strip-like film at two locations along the feed path of the strip-like film;

means for intermittently stopping a portion of the strip-like film at a location between the upstream side and the downstream side accumulating means, wherein the upstream side and downstream side accumulating means store sufficient film to allow other portions of the film to continue to be fed while a portion of the strip-like film is stopped intermittently by the intermittent stopping means; and means for printing on the portion of the strip-like film which is stopped between the downstream side and the upstream side accumulating means in the period of time during which the portion of the strip-like film is stopped.

3. A machine according to claim 2, wherein the accumulating means comprise means for causing the film to follow a meandering path, the length of each path being variable to allow further film to be accumulated or discharged.

4. A machine according to claim 3, wherein each of the upstream side and the downstream side accumulating means comprises at least one means for causing the feed path of the strip-like film to meander in an S-like shape, the machine further comprising meandering amount adjusting means including support means having the downstream and the upstream side accumulating means at each end portion thereof, the support means being pivoted so as to perform a seesaw motion with an intermediate position between the upstream side and the downstream side accumulating means as a fulcrum such that when the meandering amount of one of the upstream side accumulating means and the downstream side accumulating means is increased, the meandering amount of the other thereof is decreased.

5. A machine according to claim 2, further comprising detecting means for detecting detectable portions on the strip-like film positioned at intervals each corresponding to a length of the packaging bag, the detecting means being provided adjacent the feed path of the strip-like film, and the stopping means being responsive to the detecting means so as to stop a portion of the strip-like film based on the detection of a detectable portion by the detecting means.

6. A machine according to claim 2, wherein the driving means comprises an upstream device for feeding the film to the upstream side accumulating means, and a downstream device for feeding the film from the downstream side accumulating means.

7. A form-fill-seal packaging machine supplying commodities to packaging bags and sealing the packaging bags while forming a strip-like film into the packaging bags, said form-fill-seal packaging machine comprising:

a feeder to continuously feed the strip-like film;

an upstream side and a downstream side accumulator to respectively accumulate portions of the strip-like film at two locations along the feed path of the strip-like film;

a stopping mechanism to intermittently stop a portion of the strip-like film at a location between the upstream side and the downstream side accumulators, wherein the upstream side and downstream side accumulators store sufficient film to allow other portions of the film to continue to be fed while a portion of the strip-like film is stopped intermittently by the intermittent stopping mechanism; and a printer to print on the portion of the strip-like film which is stopped between the downstream side and the upstream side accumulators in the period of time during which the portion of the strip-like film is stopped.

8. A machine according to claim 7, wherein the accumulators each comprise a device to cause the film to follow a meandering path, the length of each path being variable to allow further film to be accumulated or discharged.

9. A machine according to claim 8, wherein each of the upstream side and the downstream side accumulators comprises at least one roller member which causes the feed path of the strip-like film to meander in an S-like shape, the machine further comprising an adjusting unit including a support member having the downstream and the upstream side accumulators at each end portion thereof, the support member being pivoted so as to perform a seesaw motion with an intermediate position between the upstream side and the downstream side accumulators as a fulcrum such that when the meandering amount of one of the upstream side accumulating means and the downstream side accumulators is increased, the meandering amount of the other thereof is decreased.

10. A machine according to claim 7, further comprising a detector to detect portions on the strip-like film positioned at intervals each corresponding to a length of the packaging bag, the detector being provided adjacent the feed path of the strip-like film, and the stopping mechanism being responsive to the detector so as to stop a portion of the strip-like film based on the detection of a detectable portion by the detector.

11. A machine according to claim 7, further comprising a driver that includes an upstream device for feeding the film to the upstream side accumulator, and a downstream device for feeding the film from the downstream side accumulator.

* * * * *

UNITED STATES PATENT AND TRADEMARK OFFICE

CERTIFICATE OF CORRECTION

PATENT NO.: 6,041,574
DATED : March 28, 2000
INVENTOR(S): Robert BENNETT

It is certified that [an/error[s]] appears in the above-identified patent and that said Letters Patent is hereby corrected as shown below:

Item [30] Foreign Application Priority Data, change "9626696" to -- 9626696.0 --

Signed and Sealed this

Fifteenth Day of May, 2001

*Attest:*

Nicholas P. Godici

NICHOLAS P. GODICI

*Attesting Officer*

*Acting Director of the United States Patent and Trademark Office*